US005658195A

United States Patent [19]

Marvin, Jr. et al.

[11] Patent Number: 5,658,195

[45] Date of Patent: Aug. 19, 1997

[54] WINDOW FAN WITH OSCILLATING FAN ENCLOSURE

[75] Inventors: Robert L. Marvin, Jr., Farmington, Conn.; Jui-Shang Wang, Taipei, Taiwan; Bernard Chiu, Wellesley, Mass.

[73] Assignee: Duracraft Corporation, Southborough, Mass.

[21] Appl. No.: 539,139

[22] Filed: Oct. 4, 1995

[51] Int. Cl.[6] ..... F24F 7/013

[52] U.S. Cl. ..... 454/200; 415/125; 454/210

[58] Field of Search ..... 454/200, 208, 454/210, 285, 338; 415/125

[56] References Cited

U.S. PATENT DOCUMENTS

| | | | |
|---|---|---|---|
| 1,011,799 | 12/1911 | Inglis | 454/200 |
| 2,452,950 | 11/1948 | Morrison | 454/210 |
| 2,805,820 | 9/1957 | Evarts | 454/200 X |
| 2,900,127 | 8/1959 | Smith | 415/125 X |
| 4,838,151 | 6/1989 | Shin-Chin | 454/200 |

*Primary Examiner*—Harold Joyce

*Attorney, Agent, or Firm*—John E. Toupal; Harold G. Jarcho

[57] ABSTRACT

A portable electric fan including a housing adapted for substantially covering a window opening, an enclosure movably mounted on the housing and defining an intake opening and a discharge opening, an enclosure drive coupled to the enclosure and operable to produce movement thereof on the housing, a movable blade mechanism retained in the enclosure and operable to produce air flow between the intake and discharge openings and a blade drive coupled to the blade mechanism and operable to produce movement thereof.

32 Claims, 5 Drawing Sheets

WINDOW FAN WITH OSCILLATING FAN ENCLOSURE

BACKGROUND OF THE INVENTION

This invention relates generally to a portable electric fan and, more particularly, to a portable electric window fan.

Portable electric fans are used extensively to reduce personal discomfort caused by excessive temperatures. Some portable electric fans are designed specifically for mounting in open windows of inhabited enclosures and are typically operable to either exhaust air from the enclosure or direct outside air thereinto. Although generally quite efficient for establishing desirable air circulation between inside and outside of a particular enclosure, prior window fans have failed to provide fully satisfactory air flow patterns because of positional mounting limitations. For example, conventional window fans do not provide the variety of air flow distribution patterns furnished in a wider variety of positions.

In efforts to extend air circulation patterns,some prior fans have been provided with automatically movable frames. For example, U.S. Pat. No. 2,786,627 discloses a portable fan with an oscillating fan blade. However, such prior portable fans have not been capable of producing efficient air movement through an open window.

The object of this invention, therefore, is to provide an improved, more versatile portable window fan.

SUMMARY OF THE INVENTION

The invention is a portable electric fan including a housing adapted for substantially covering a window opening, an enclosure movably mounted on the housing and defining an intake opening and a discharge opening, an enclosure drive coupled to the enclosure and operable to produce movement thereof on the housing, a movable blade mechanism retained in the enclosure and operable to produce air flow between the intake and discharge openings and a blade drive coupled to the blade mechanism and operable to produce movement thereof. The movable enclosure provides variable air flow patterns with the fan mounted in an open window.

According to features of the invention, the blade drive is retained by the enclosure, the enclosure drive includes a drive linkage coupled to the enclosure and operative to produce oscillating movement thereof, and the enclosure includes a grill covering the discharge opening and a grill covering the intake opening. These features enhance safe operation and simplified construction of the fan.

According to another feature of the invention, the enclosure drive includes an electric motor mounted in the housing. This feature facilitates construction of a compact, efficient movable enclosure.

According to another feature of the invention, the housing defines a receptacle opening extending therethrough and the enclosure is disposed in the receptacle opening. This feature provides the fan with a compact easily assembled configuration.

According to still another feature of the invention, the enclosure has wall portions spaced from edges of the receptacle opening and the wall portions and the edges are shaped and arranged to create therebetween a substantially uniform gap during oscillating movement of the enclosure. The provision of a uniform gap permits minimization of gap width to enhance air flow characteristics of the fan.

According to another feature of the invention, the wall portions are concentrically curved. The concentrically curved wall portions establish a desired uniform gap.

According to yet another feature of the invention, the wall portions are either cylindrical or spherical. The cylindrical or spherical wall portions provide the desired concentric curvature.

According to a further feature of the invention, the housing has side walls out of which movable wing walls project,a bottom wall for mounting on a sill of the window, a top wall for engaging a sash of the window, a rear wall intersected by the receptacle opening and a front wall defining a recess accommodating the movement of the enclosure and the recess at least partially forms the receptacle opening. These features enhance operation of the fan when mounted in an open window.

According to an additional feature of the invention, the enclosure has a curved outer surface and the receptacle opening has edges substantially conforming to the outer surface. The conforming surfaces facilitate the desirable provision of a uniform gap during movement of the enclosure.

According to other features of the invention, the outer surface is substantially cylindrical, the opposite edges include portions substantially rectilinear and parallel, and the fan includes an air seal disposed between the receptacle opening and the enclosure. The air seal enhances air flow characteristics of the fan.

According to still other features of the invention, the housing has horizontally aligned end portions of a given width and a central portion straddled by the end portions and having an extended portion projecting forwardly thereof, and the extended portion defines the recess and bearings pivotally retaining the enclosure. These features facilitate construction of a compact fan ideally suited for window mounting.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
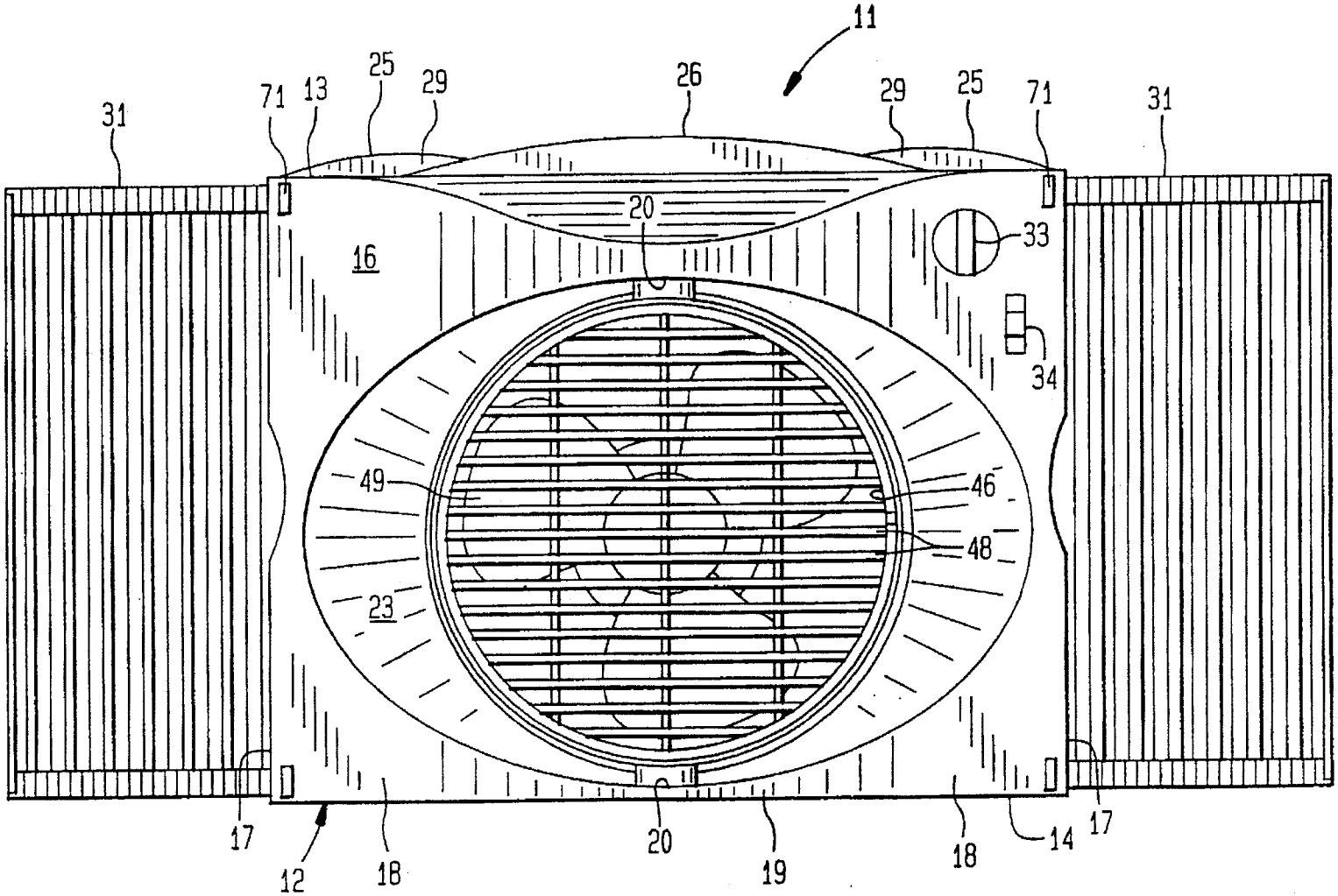
FIG. 1 is a front elevational view of a fan according to the invention.
Figure 2:
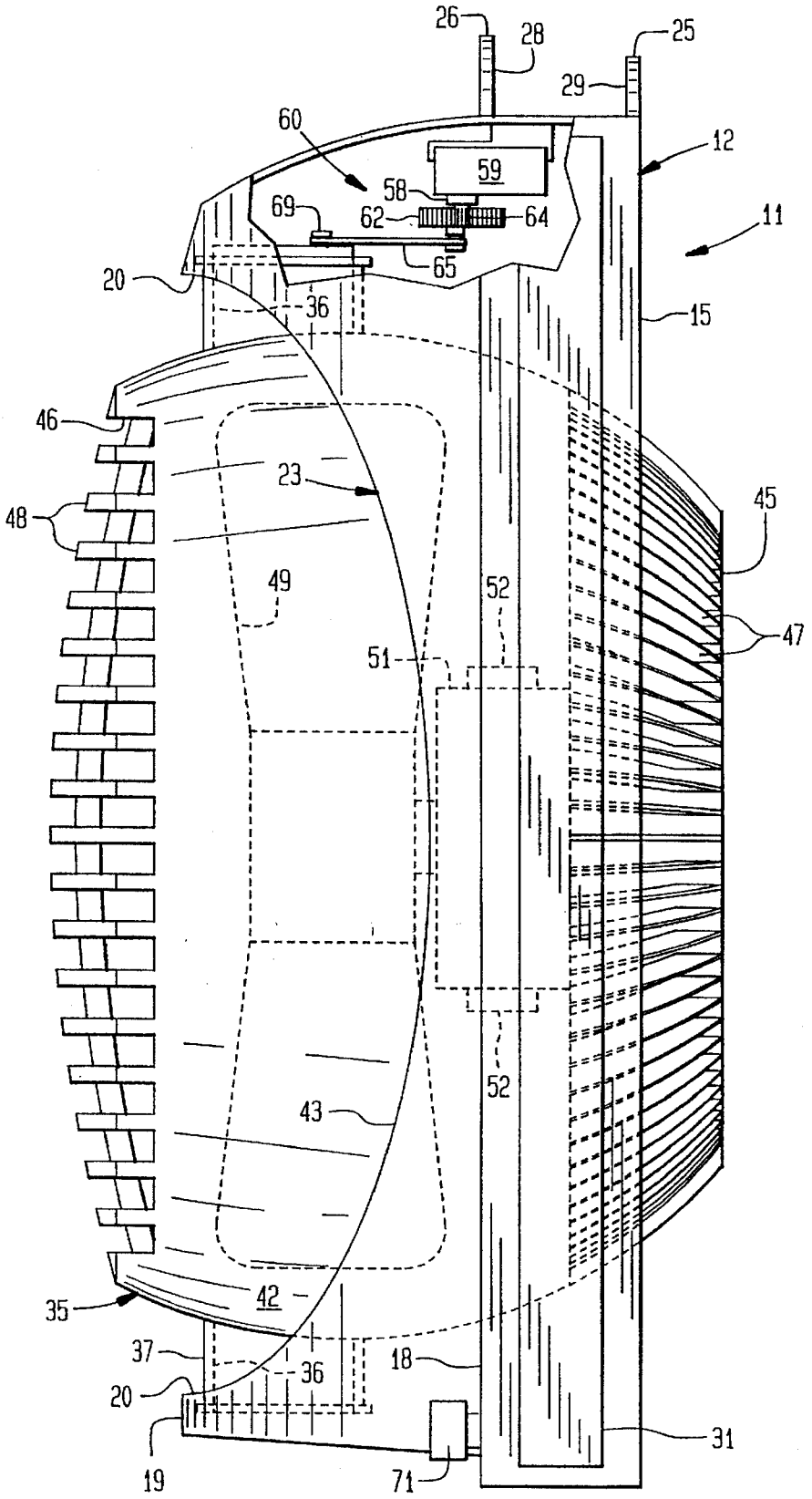
FIG. 2 is a side elevational view of the fan shown in FIG. 1.
Figure 3:
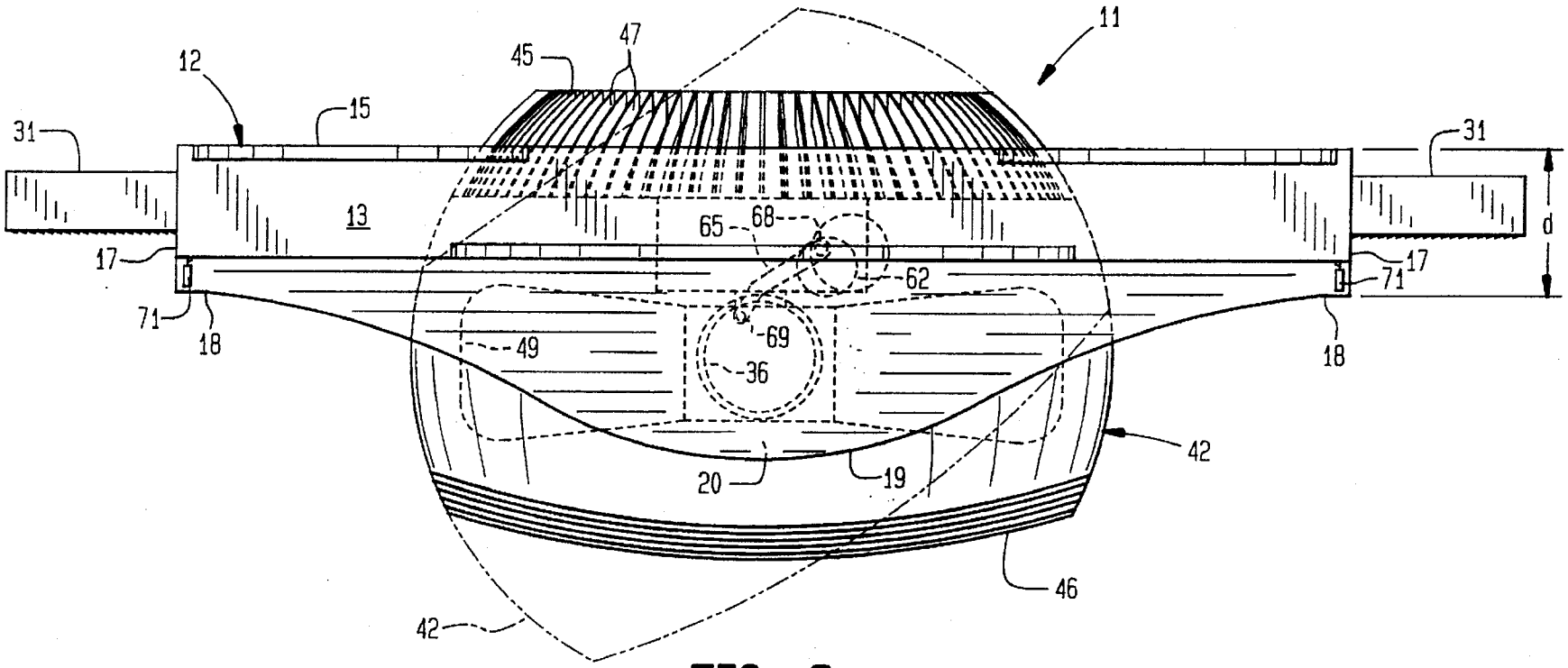
FIG. 3 is a top view of the fan illustrated in FIG. 1.
Figure 4:
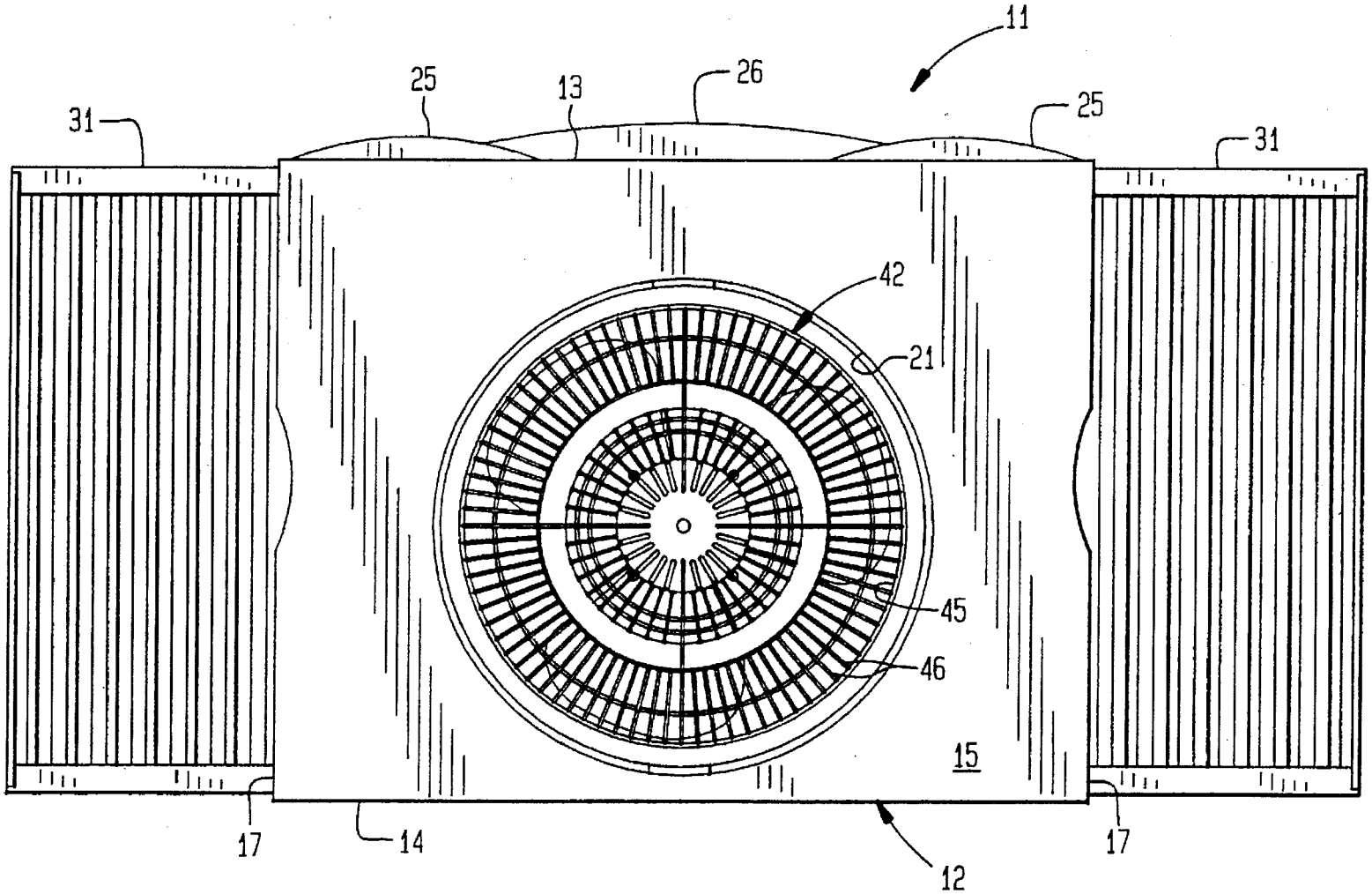
FIG. 4 is a rear elevational view of the fan shown in FIG. 1.

A portable electric fan 11 has a housing 12 with a top wall 13, a bottom wall 14, a rear wall 15, a front wall 16 and side walls 17. The rear wall 15 defines an inlet opening 21 and the front wall 16 defines a recess 22. Side portions 18 of the housing 12 are horizontally aligned and have a given width d (FIG. 3). The side portions straddle a central portion 19 having extended portions 20 projecting forwardly thereof. Defined by the top wall 13 are a pair of upwardly projecting longitudinally aligned rear tabs 25 and an upwardly projecting front tab 26 transversely spaced from the rear tabs 25. The front tab 26 forms a rearwardly facing surface 28 and the rear tabs 25 form forwardly facing surfaces 29. Projecting from each of the side walls 17 is an extendable wing wall 31 of a type disclosed in U.S. Pat. No. 5,382,136. As shown in FIG. 1, a speed selector switch 33 and an oscillation control switch 34 are mounted on the front wall 16.

An enclosure 35 is pivotally mounted on the housing 12 and extends through the inlet opening 21. Aligned shafts 36 projecting from upper and lower portions of the enclosure are retained in pivot bearings 37 formed in the extended portions 20 of the housing 12. Forming the enclosure 35 is a shell 42 having spherically curved outer surface 43 extending between an intake opening 45 and a discharge opening 46. The intake opening 45 is covered by an intake grill 47 and the discharge opening 46 is covered by a discharge grill 48. Retained within the enclosure 35 is a movable blade mechanism consisting primarily of a fan blade 49. Also retained within the enclosure 41 is a blade drive motor 51 supported by the shell 42 on brackets 52. The drive motor 51 is operatively coupled to the fan blade 49 by a drive shaft 53.

Formed by the recess 22 is a receptacle opening 55 that intersects the inlet opening 21 in the rear wall 15. An outer surface portion of the recess 22 is eliptically concave and an inner surface portion is spherical so as to define for the receptacle opening 55 an annular edge that substantially conforms to the spherical outer surface 43 of the shell 42. Thus, during horizontal oscillating movement of the enclosure 35 on the shafts 36, a substantially uniform gap is maintained between the outer surface 43 and the inner surface portion of the recess 22. During such movement of the enclosure 35, the eliptically concave outer surface portion of the recess 22 prevents obstruction of air flow produced by the fan blade 49.

Figure 5:
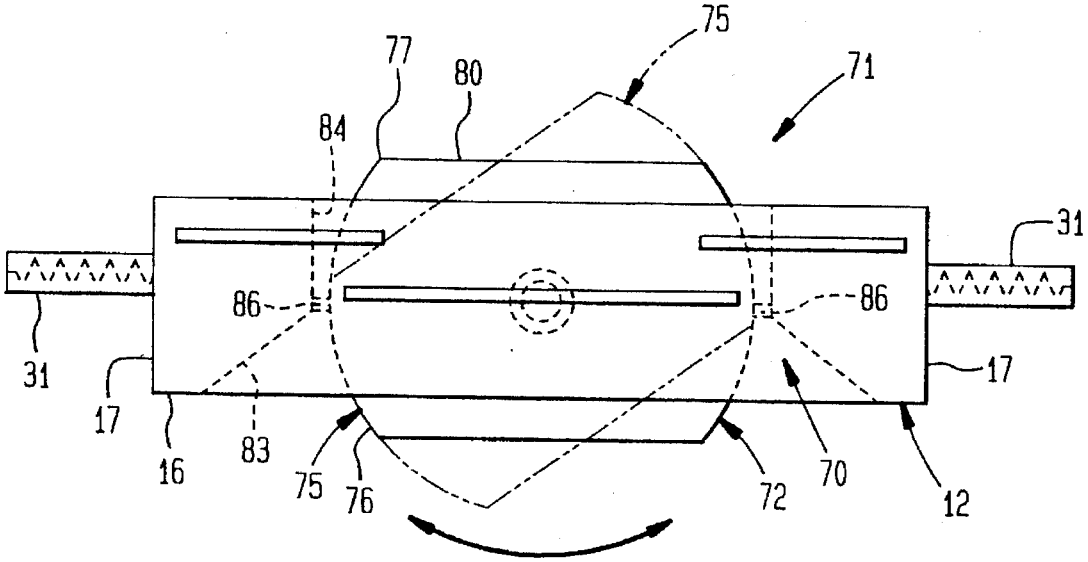
FIG. 5 is a top view illustrating another fan embodiment of the invention.

Illustrated in FIG. 5 is an enclosure drive mechanism 58 supported by the housing 12 and operatively connected to the enclosure 35. Included in the drive mechanism 58 are an electric motor 59 and a coupling 60 connected between a shaft 61 of the motor 59 and the shell 42 of the enclosure 35. A planetary gear 64 is fixed for rotation with the shaft 51 and engages a drive wheel gear 62 so as to produce rotation thereof in response to energization of the motor 59. As shown in FIG. 3, a drive arm 65 has one end pivotally connected to a radially outer portion 68 of the drive wheel 62 and an opposite end pivotally attached to a boss 69 at a point on the shell 42 horizontally spaced from the center of the upper pivot shaft 36.

Prior to use, the bottom wall 14 of the window fan 11 is mounted on a sill (not shown) of an open window and a sash (not shown) is lowered into engagement with the top wall 13 between the facing surfaces 28 and 29, respectively, of the front tab 26 and the rear tabs 25. After release of latch members 71, the wing walls 31 are extended from the side walls 17 into engagement with side surfaces of the open window. Actuation of the selector switch 33 then will energize the motor 51 to produce rotation of the fan blade 49 and resultant air flow through the enclosure 35 between the intake opening 45 and the discharge opening 46. The oscillation control switch then can be actuated to energize the motor 59 and produce rotation of the drive gear wheel 62 (FIG. 5) via the planetary gear 64 and the shaft 61. Rotation of the drive wheel 62 alternately pushes and pulls on the drive arm 65 causing horizontal oscillating movement of the enclosure 35 on the housing 12. Thus, air flow out of the discharge opening 46 is continuously directed in horizontally changing directions. During this oscillation of the enclosure 35, the conforming surfaces of the receptacle opening 55 and the shell 42 maintain a uniformly small air gap that desirably restricts air flow between the intake opening 45 and the region adjacent to the front wall 16 of the fan 11.

Figure 6:
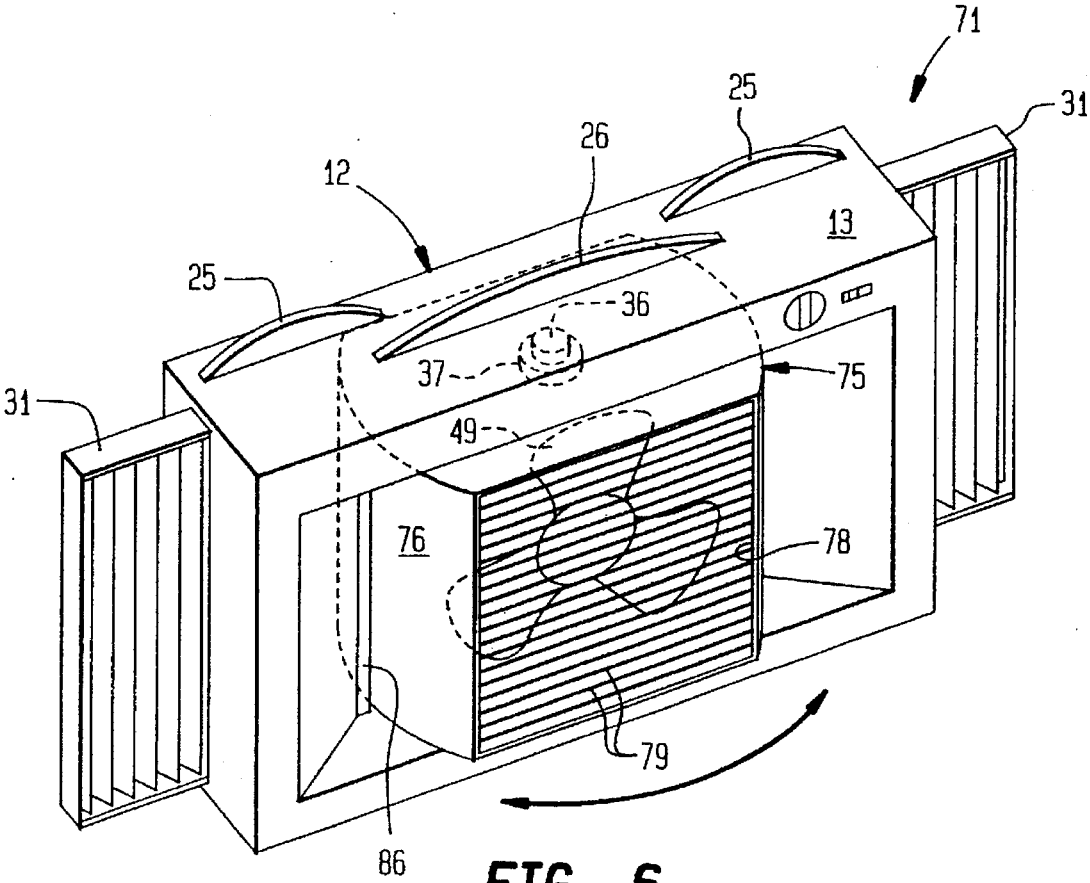
FIG. 6 is a front perspective view of the fan shown in FIG. 5.

Illustrated in FIG. 6 is another window fan embodiment 71 of the invention. The embodiment 71 is similar to the embodiment 11 shown in FIGS. 1–4 and related components thereof have been given the same reference numerals. As in the embodiment 11, the window fan 71 includes an enclosure 72 mounted for oscillating movement within a receptacle opening 70 extending between rear and front walls 15, 16 of a housing 12. The enclosure 71 comprises a shell 75 having concentric cylindrical walls 76 extending between an intake opening 77 covered by a grill 80 and a discharge opening 78 covered by a grill 79. Forming the receptacle opening 70 is a recess having an outer portion with inwardly tapered walls 83 and an inner portion with spaced apart, vertically parallel wall edges 84 that provide with the walls 76 a uniform gap during rotation of the enclosure 72. An air seal between the intake opening 77 and the housing 12 is provided by gasket 86 disposed between the surfaces 76 and 84.

The enclosure 72 retains a rotatable blade 49 and electric motor 51 operable to produce air flow between the intake opening 77 and the discharge opening 78. Coupled between the enclosure. 72 and the housing 12 is an enclosure drive mechanism 58 (not shown) as described above in connection with FIG. 3 and operational to produce rotational oscillating movement of the shell 75 within the receptacle opening 70 in the housing 12. Use of the embodiment 71 is the same as described above for the embodiment 11 and the gasket 86 further restricts air flow between the intake opening 77 and the region in front of the housing 12.

Obviously, many modifications and variations of the present invention are possible in light of the above teachings. It is to be understood, therefore, that the invention can be practiced otherwise than as specifically described.

We claim:

1. A portable electric fan comprising:

a housing shaped and arranged for substantially filling a rectangularly shaped window opening;

an enclosure movably mounted on said housing and defining an intake opening and a discharge opening;

an enclosure drive coupled to said enclosure and operable to produce movement thereof on said housing;

a movable blade mechanism retained in said enclosure and operable to produce air flow between said intake and said discharge openings; and a blade drive coupled to said blade mechanism and operable to produce movement thereof.

2. A fan according to claim 1 wherein said blade drive is retained by said enclosure.

3. A fan according to claim 1 wherein said enclosure drive comprises a drive linkage coupled to said enclosure and operative to produce oscillating movement thereof.

4. A fan according to claim 1 including a grill covering said discharge opening.

5. A fan according to claim 4 including a grill covering said intake opening.

6. A fan according to claim 1 wherein said blade mechanism is a fan blade and said blade drive comprises an electric motor retained by said enclosure.

7. A fan according to claim 6 wherein said enclosure drive comprises an electric motor mounted in said housing.

8. A fan according to claim 1 wherein said housing defines a receptacle opening extending therethrough and said enclosure is disposed in said receptacle opening.

9. A fan according to claim 8 wherein said blade drive is retained by said enclosure.

10. A fan according to claim 8 wherein said enclosure drive comprises a drive linkage coupled to said enclosure and operative to produce oscillating movement thereof.

11. A fan according to claim 8 including a grill covering said discharge opening.

12. A fan according to claim 11 including a grill covering said intake opening.

13. A fan according to claim 8 wherein said blade mechanism is a fan blade and said blade drive comprises an electric motor retained by said enclosure.

14. A fan according to claim 13 wherein said enclosure drive comprises an electric motor mounted in said housing.

15. A fan according to claim 8 wherein said enclosure drive is operative to produce oscillating movement of said enclosure.

16. A fan according to claim 15 wherein said enclosure has wall portions spaced from edges of said receptacle opening and said wall portions and said edges are shaped and arranged to create therebetween a substantially uniform gap during said oscillating movement of said enclosure.

17. A fan according to claim 16 wherein said wall portions are concentrically curved.

18. A fan according to claim 17 wherein said wall portions are cylindrical.

19. A fan according to claim 17 wherein said wall portions are spherical.

20. A portable electric fan comprising:

a housing adapted for substantially covering a window opening and defining a receptacle opening extending therethrough; said housing having side walls, a bottom wall for mounting on a sill of the window, a top wall for engaging a sash of the window, a rear wall intersected by said receptacle opening and a front wall defining a recess at least partially forming said receptacle opening;

an enclosure mounted on said housing, disposed for movement in said receptacle opening and defining an intake opening and a discharge opening;

an enclosure drive coupled to said enclosure and operable to produce oscillating movement thereof on said housing;

a moveable blade mechanism retained in said enclosure and operable to produce air flow between said intake and said discharge opening; and a blade drive coupled to said blade mechanisms and operable to produce movement thereof.

21. A fan according to claim 20 wherein said enclosure has a curved outer surface and said receptacle opening has edges substantially conforming to said outer surface.

22. A fan according to claim 21 wherein said outer surface is susbtantially spherical and said recess is eliptically concave.

23. A fan according to claim 21 wherein said outer surface is substantially cylindrical and said opposite edges include portions substantially rectilinear and parallel.

24. A fan according to claim 20 including a wing wall extendable out of each of said side walls.

25. A fan according to claim 24 wherein said top wall defines spaced apart surfaces for straddling the window sash.

26. A fan according to claim 20 wherein said housing has horizontally aligned end portions having a given width and a central portion straddled by said end portions and having an extended portion projecting forwardly thereof, said extended portion defining said recess and bearings pivotally retaining said enclosure.

27. A portable electric fan comprising:

a housing adapted for substantially covering a window opening and defining a receptacle opening;

an enclosure movably mounted on said housing within said receptacle opening and defining an intake opening and a discharge opening;

an enclosure drive coupled to said enclosure and operable to produce movement thereof on said housing;

a movable blade mechanism retained in said enclosure and operable to produce air flow between said intake and said discharge openings;

a blade drive coupled to said blade mechanism and operable to produce movement thereof; and an air seal disposed between said receptacle opening and said enclosure.

28. A fan according to claim 27 wherein said enclosure is disposed in said receptacle opening.

29. A fan according to claim 28 wherein said enclosure drive is operative to produce oscillating movement of said enclosure.

30. A fan according to claim 29 wherein said enclosure has wall portions spaced from edges of said receptacle opening and said wall portions and said edges are shaped and arranged to create therebetween a substantially uniform gap during said oscillating movement of said enclosure.

31. A fan according to claim 30 wherein said wall portions are concentrically curved.

32. A fan according to claim 31 wherein said wall portions are cylindrical.

* * * * *